United States Patent [19]

Eplett et al.

[11] Patent Number: 4,474,024

[45] Date of Patent: Oct. 2, 1984

[54] DEFROST CONTROL APPARATUS AND METHOD

[75] Inventors: F. Russell Eplett; Mario F. Briccetti, both of Liverpool, N.Y.

[73] Assignee: Carrier Corporation, Syracuse, N.Y.

[21] Appl. No.: 459,293

[22] Filed: Jan. 20, 1983

[51] Int. Cl.[3] ..... F25D 21/02

[52] U.S. Cl. ..... 62/140; 62/80; 62/154

[58] Field of Search ..... 62/80, 140, 128, 154; 340/580, 658; 324/83 R, 83 A, 83 D; 361/30, 79

[56] References Cited

U.S. PATENT DOCUMENTS 3,588,710 6/1971 Masters ..... 325/83 D X
3,701,013 10/1972 Gilmore ..... 324/83 D
4,025,848 5/1977 Delagrange et al. ..... 324/83 A X
4,104,888 8/1978 Reedy et al. .
4,123,792 10/1978 Gephart et al. .
4,246,497 1/1981 Lawson et al. ..... 324/83 A X

*Primary Examiner*—Harry B. Tanner
*Attorney, Agent, or Firm*—David L. Adour

[57] ABSTRACT

Method and apparatus are disclosed wherein a circuit for detecting the phase angle of a motor is disclosed. This circuit utilizes zero crossing detectors to compare the voltage and current signals such that a digital signal indicating the value of the phase angle by the duration of the signal is generated. Additionally, a method and apparatus for comparing the phase angle to the reference phase angle value is disclosed. Means for updating the reference value and for comparing the detected value to the reference value to determine appropriate defrost initiation time are additionally disclosed.

6 Claims, 4 Drawing Figures

DEFROST CONTROL APPARATUS AND METHOD

BACKGROUND OF THE INVENTION

1. Field of the Invention

This invention relates to apparatus and a method for controlling a defrost cycle for effecting defrost of an ice accumulating heat exchanger. More specifically, the present invention concerns initiating a defrost cycle based on the phase angle of the electric motor powering the compressor in a refrigeration circuit.

2. Prior Art

Air conditioners, refrigerators and heat pumps produce a controlled heat transfer by the evaporation in a heat exchanger of a liquid refrigerant under appropriate pressure conditions to produce desired evaporator temperatures. Liquid refrigerant removes its latent heat of vaporization from the medium being cooled and in this process is converted into a vapor at the same pressure and temperature. This vapor is then conveyed into a compressor wherein its temperature and pressure are increased. The vapor then is conducted to a separate heat exchanger serving as a condenser wherein the gaseous refrigerant absorbs its heat of condensation from a heat transfer fluid in heat exchange relation therewith and changes state from a gas to a liquid. The liquid is supplied to the evaporator after flowing through an expansion device which acts to reduce the pressure of the liquid refrigerant such that the liquid refrigerant may evaporate within the evaporator to absorb its heat of vaporization and complete the cycle.

The specific application incorporating this refrigeration circuit utilizes a heat exchanger serving as an evaporator wherein the evaporator is either located in ambient air at a temperature below the freezing point of water or wherein the heat exchanger itself has a surface temperature below the freezing point of water. In either event, as air is circulated over the heat exchanger, water vapor in the air is condensed and frozen on the surfaces of the heat exchanger. As the frost accumulates on the heat exchanger a layer of ice is built up between the portion of the heat exchanger carrying refrigerant and the air flowing thereover. This layer of ice acts as an insulating layer inhibiting the heat transfer between refrigerant and air. Additionally, the ice may serve to block narrow air flow passageways between fins utilized to enhance heat transfer. This additional effect further serves to reduce heat transfer since lesser amounts of air will be circulated in heat exchange relation with the refrigerant carrying conduits.

To effectively utilize a refrigeration circuit wherein the evaporator may encounter these conditions, such as a heat pump operating in relatively low outdoor ambient air conditions or the evaporator of a refrigeration circuit for a cold room, it is necessary to provide apparatus for removing the accumulated frost. Many conventional methods are known such as supplying electric resistance heat, reversing the heat pump such that the evaporator becomes a condenser or other refrigerant circuiting techniques to direct hot gaseous refrigerant directly to the frosted heat exchanger.

Many of these defrost techniques utilize energy that is not effectively used for transferring heat energy to a space to be conditioned or to another end use served by the entire system. To reduce the amount of heat energy wasted or otherwise consumed in the defrost operation it is a design selection to utilize a defrost system which places the refrigeration circuit in the defrost mode only when needed.

Different types of control systems have been utilized for initiating defrost. A combination of a timer and a thermostat may be used to determine when to initiate defrost. The timer periodically checks to see whether or not the evaporator temperature or a temperature dependent thereon is below a selected level, and if so acts to place the system in defrost. Other types of prior art defrost initiation systems have included measuring infrared radiation emitted from the fins of the refrigerant carrying coil, measuring the air pressure differentials of the air flow flowing through the heat exchanger, measuring multiple independent variables that would indicate icing, utilizing an electrical device placed on the fin whose characteristics change depending on the temperature of the device, optical-electrical methods and other methods involving the monitoring of various electrical parameters.

The present invention is directed towards sensing the phase angle of the motor driving the compressor. It has been found that as the load on the electric motor decreases the power factor of the motor decreases and the phase angle increases. The phase angle, as used herein, shall refer to the difference in angle between the voltage supplied to the compressor and the current flowing through the compressor. Hence, as the load on the compressor varies, the phase angle will vary. By determining the appropriate phase angle at a frost free condition the maximum load on the refrigeration circuit is determined. As the heat exchanger accumulates frost the load on the compressor motor decreases since the amount of heat energy that is being transferred decreases due to the inefficiencies developing in the heat exchanger having the frost accumulated thereon. As the load on the compressor decreases the load on the compressor motor decreases and consequently its phase angle increases. By comparing the change in the phase angle between the frost free condition as compared to the sensed condition an appropriate differential therebetween may be utilized to initiate defrost.

SUMMARY OF THE INVENTION

It is an object of the present invention to provide a defrost control for use with a refrigeration circuit.

It is a further object of the present invention to provide a method of determining when to initiate defrost for an air conditioning or a refrigeration circuit.

It is a further object of the present invention to provide a sensing method which may readily determine a basis upon which to effect defrost when measuring parameters of the electrical circuit serving the compressor motor of the refrigeration circuit.

It is another object of the present invention to provide a method and apparatus of utilizing collected phase angle data to initiate defrost.

It is a yet further object of the present invention to provide a safe, economical, reliable and easy to manufacture and install defrost apparatus.

It is a yet further object of the present invention to provide a phase angle detection circuit capable of generating a digital signal suitable for use by a microcomputer for determining when to initiate defrost.

It is a yet further object of the present invention to provide a defrost scheme suitable for use in a microprocessor controlled heat pump for regulating defrost.

Other objects will be apparent from the description to follow and the appended claims.

These and other objects are achieved in accordance with the present invention wherein there is provided a method of determining when to initiate a defrost cycle to remove accumulated frost from a heat exchanger forming a portion of a refrigeration circuit. An electric motor driven compressor is included in the refrigeration circuit and the method of determining when to initiate defrost includes determining a reference phase angle equal to the phase angle of the electric motor driving the compressor when the heat exchanger is in a frost free condition, monitoring the operating phase angle of the electric motor, comparing the operating phase angle to the reference phase angle, and initiating a defrost cycle when the step of comparing determines the operating phase angle exceeds the reference phase angle by a predetermined value.

Additionally, a circuit for generating a signal indicative of the phase angle of an electric motor connected to an alternating current power source is disclosed. First means connected to the power source for detecting when the voltage of the power source has either a positive or negative value and for generating a first signal when a positive value is detected or alternatively when a negative value is detected and second means connected between the power source and the motor for detecting when the current flowing through the motor has either a negative or positive value and for generating a second signal when a negative value is detected or alternatively when a positive value is detected. Additionally, output means are provided for generating an output signal when both the first signal and the second signal connected thereto are present such that the duration of said output signal is indicative of the phase angle being monitored.

DESCRIPTION OF THE PREFERRED EMBODIMENT

The embodiments hereinafter described will refer to a specific circuit for monitoring and detecting the phase angle of an electric motor. It is to be understood that other circuits for achieving the same effect could equally be utilized as concerns the overall defrost method and apparatus. Additionally, it is to be understood that the overall defrost method and apparatus as set forth herein is designed to be accomplished utilizing a microcomputer but other apparatus and methods such as hard wired components or manual manipulation of the defrost initiation means could likewise be utilized to achieve the same results.

Figure 1:
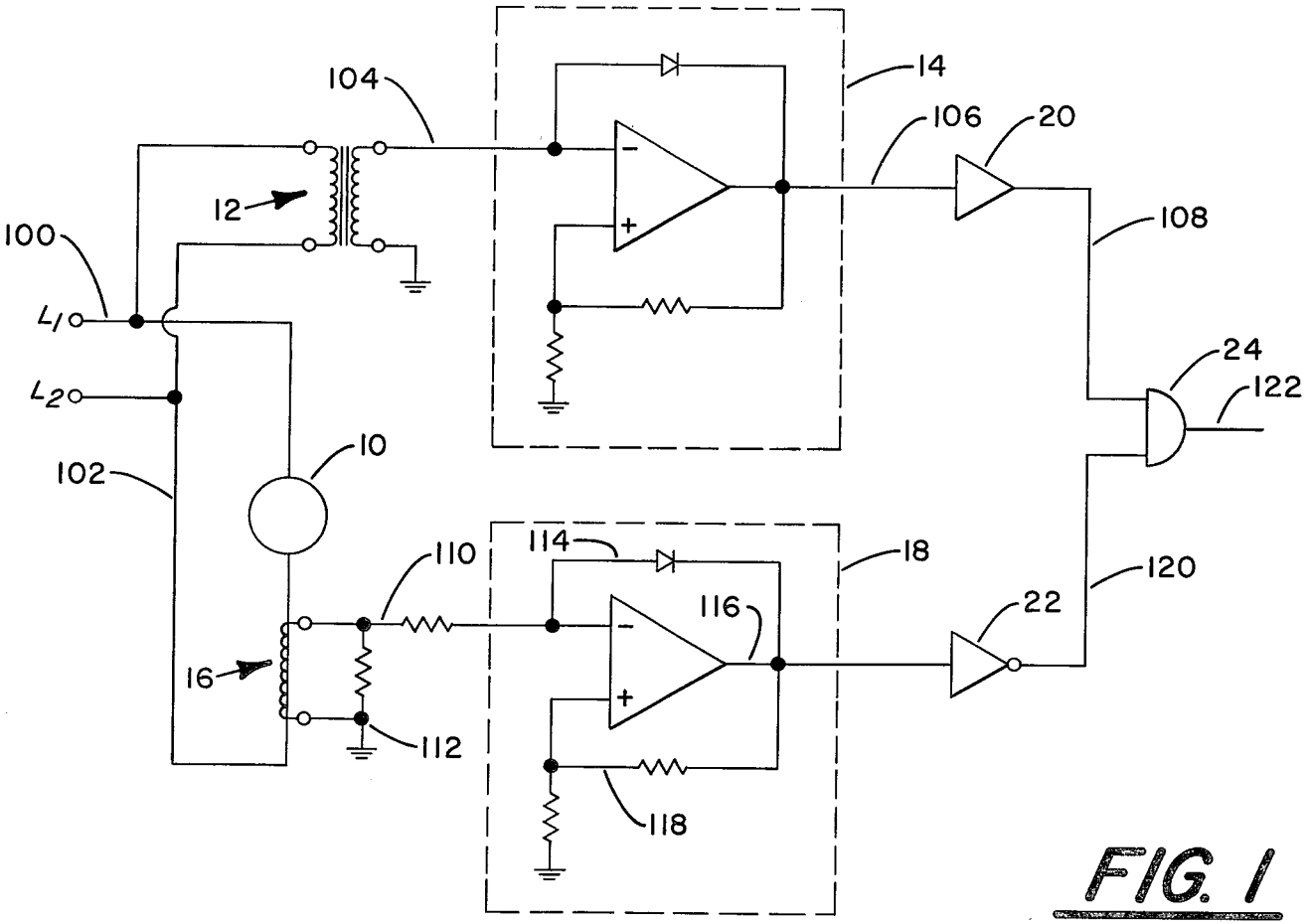
FIG. 1 is a wiring schematic showing a circuit for detecting phase angle.

Referring now to FIG. 1 there may be seen a wiring schematic of a circuit for sensing phase angle of a compressor motor. Therein it may be seen that power is supplied to the circuit through lines $L_1$ and $L_2$. Compressor motor 10 is connected between lines $L_1$ and $L_2$ such that power is supplied thereto. Wire 100 connects compressor motor 10 and voltage transformer 12 to line $L_1$. Line $L_2$ is connected via wire 102 to compressor motor 10 and voltage transformer 12.

Current transformer 16 is shown having its winding located about wire 102 between compressor motor 10 and line $L_2$ such that the current transformer senses the current flowing between the compressor and the power source. Current transformer 16 is connected via wires 112 and 110 to zero crossing detector 18. Zero crossing detector 18 is connected via wire 116 to inverter buffer 22 which is connected via wire 120 to And gate 24.

Voltage transformer 12 has its primary winding connected via wires 100 and 102 to a power source including lines $L_1$ and $L_2$ and a secondary winding is connected to ground and via wire 104 to zero crossing detector 14. Zero crossing detector 14 is connected by wire 106 to buffer 20 which is connected by wire 108 to And gate 24. Wire 122 is connected to and carries the output of And gate 24.

Both zero crossing detectors 14 and 18 include an operational amplifier connected respectively to incoming wires 104 and 110. The zero crossing detectors act to generate a square wave signal during that period when the value of the signal on wires 104 and 110 is either positive or negative. The operation of these two zero crossing detectors will be more explicitly described in reference to FIG. 2.

Figure 2:
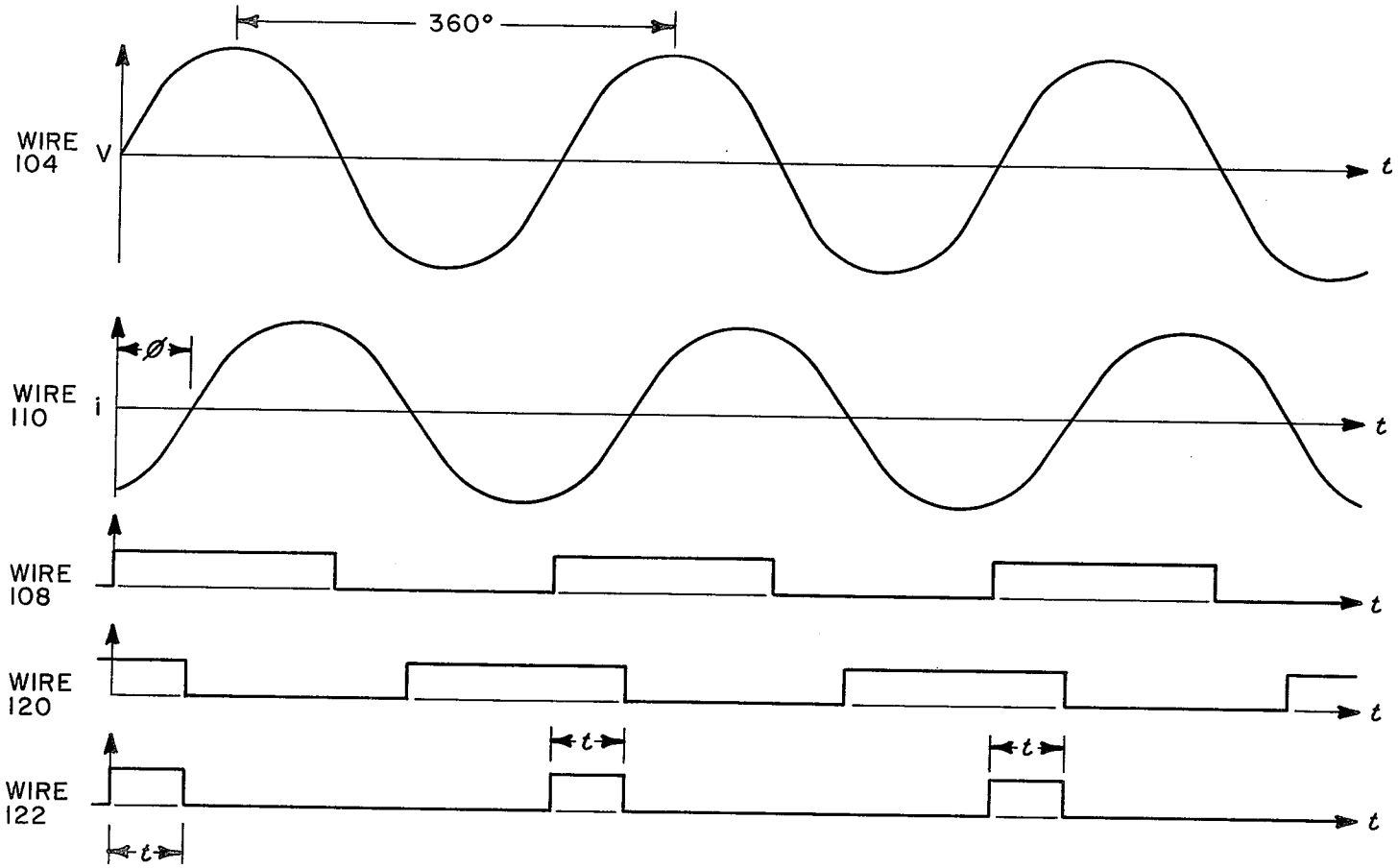
FIG. 2 is a series of wave diagrams taken from various points of the circuit in FIG. 1.

Referring now to FIG. 2 there may be seen a series of five graphs representing the various signals on wires 104, 110, 108, 120 and 122 in order. These graphs are all plotted against time. The top graph labeled wire 104 is a graph of the voltage detected at the power source and is a typical sine wave. This would be the signal passing from wire 104 to zero crossing detector 14. The second graph labeled wire 110 is a graph of the signal generated by the current transformer 16 and again would be the signal on wire 110. It should be noted that the graph of wire 104 commences at zero and rises in a normal sine wave. The graph of wire 110 is again a sine wave but displaced slightly from the graph of wire 104. The angular displacement between the zero crossing points in wires 104 and 110 is an angular distance labeled phi. This is the phase angle between the voltage and current of the motor.

The third graph labeled wire 108 is a representation of the signal generated by zero crossing detector 14. Zero crossing detector 14 is provided such that a square wave is generated whenever the voltage level of signal wire 104 is positive. Hence, wire 108 has a square wave function of fixed amplitude at all times when the sine wave of wire 104 is above the zero line and has no signal at all times the wave is below the zero line as shown in the graph of the signal on wire 104. Similarly, wire 120 is shown having a square wave generated whenever the signal as shown in the graph of wire 110 is negative or below the zero current line. Hence, it may be seen at wire 120 that the signal occurs during that half of the operating time when the sine wave is below the zero line. It can be noted from FIG. 1 that buffer 22 acts to invert zero crossing detector 18 such that the signal is generated when the signal in wire 110 is negative rather than positive.

The fifth graph labeled wire 122 is the output signal from And gate 24. This graph shows a solid wave form signal generated during those times when a positive signal is present on both wires 108 and 120. The duration of the signal would indicate the length of time when the voltage signal (wire 104) is positive while the other signal or current signal (wire 120) is negative. The length of this time would be equivalent to the phase angle when converted to degrees. For a sixty hertz power source the phase angle is 21.6° per millisecond. Hence, by determining the duration of each signal pulse on wire 122 the phase angle may be determined. It is a conventional step to digitally count the length of the pulse on wire 122 to determine its duration. Multiplying the duration of the pulse by 21.6° per millisecond will provide the desired phase angle amount.

The above description of the operation of the zero phase detectors and the circuit of FIG. 1 assumes that the positive portion of the voltage signal is compared to the negative portions of the current signal. A similarly suitable measurement can be obtained comparing the negative values of the voltage signal with the positive values of the current signal. Additionally, the positive portions of the voltage wave could be compared to the positive portions of the current wave to determine the length of time when two waves are in phase and thus by subtracting the inphase time from the total time of each wave or 1/60th of a second the measurement of the time when the two are out of phase such as described would also be determined. Again, the angular displacement could be determined therefrom by multiplying the time in milliseconds by 21.6° per millisecond to determine the phase angle.

Figure 3:
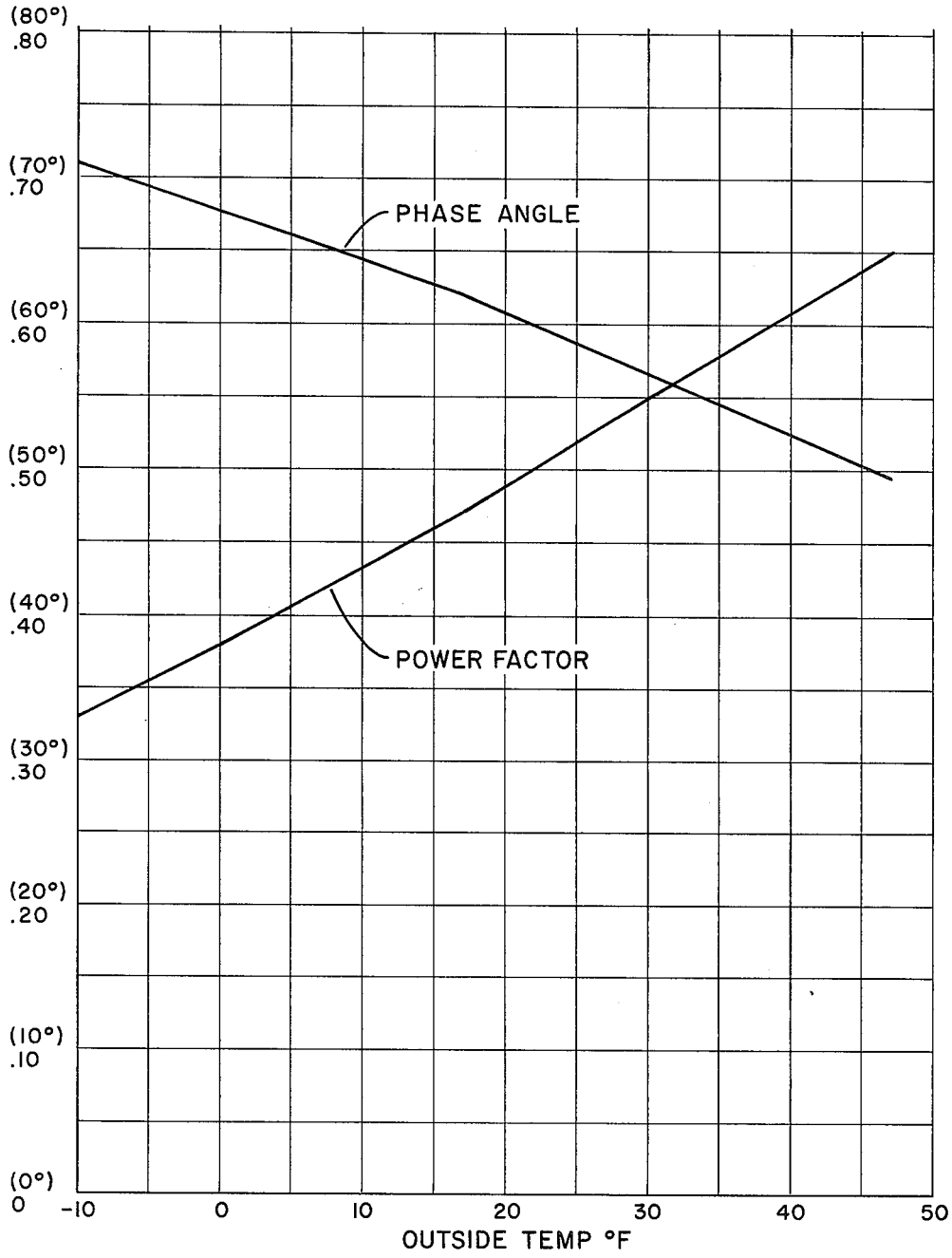
FIG. 3 is a graph of phase angle and power factor versus the outdoor temperature for a selected compressor motor applied to a specific refrigeration circuit.

FIG. 3 is a graph wherein both power factor and phase angle are plotted versus outdoor temperature for a selected compressor motor. From this graph it can be seen that the phase angle of the compressor motor rises as the temperature drops. In other words, as the outdoor temperature becomes lower the phase angle becomes higher indicating there is a decreased load or torque on the compressor motor. Naturally, the inverse is true for the power factor. As the outdoor temperature rises the power factor rises. Since the power factor is defined as the cosine of the phase angle this relationship would naturally be assumed.

The actual operation of a heat pump would involve the outdoor heat exchanger which is serving as an evaporator being located in communication with the outdoor air. Hence, the phase angle would change as the temperature changes. It can be seen from the graph that this relationship is generally linear. From this particular compressor motor it is calculated to be approximately −0.425° of phase angle per degree farenheit decrease in temperature.

This relationship can be utilized to initiate defrost since when the heat exchanger frosts or ices up the overall heat transfer capability decreases.. The refrigerant flowing through the heat exchanger will then be incapable of transferring the amount of heat energy to the ambient air as was previously being transferred. Hence, the temperature of the heat exchanger drops affecting the phase angle in the same manner as if the outdoor ambient temperature dropped. Defrost is then initiated upon a detection of the phase angle change based upon the temperature change of the heat exchanger. This drop in heat exchanger temperature due to frosting would be much more rapid than a drop in outdoor temperature due to natural ambient temperature swings.

Additionally, as will be hereinafter described, the method of utilizing the phase angle to initiate defrost provides for constantly updating a reference phase angle value to take into account the changing outdoor ambient temperature. Hence, should the outdoor temperature be rising such that the phase angle is continually decreasing simply because the heat exchanger is located in the increasing temperature ambient the reference phase angle to which the operating angle is compared will be continually decreased also such that the change in outdoor ambient temperature will not effect the determination of when to initiate defrost.

Figure 4:
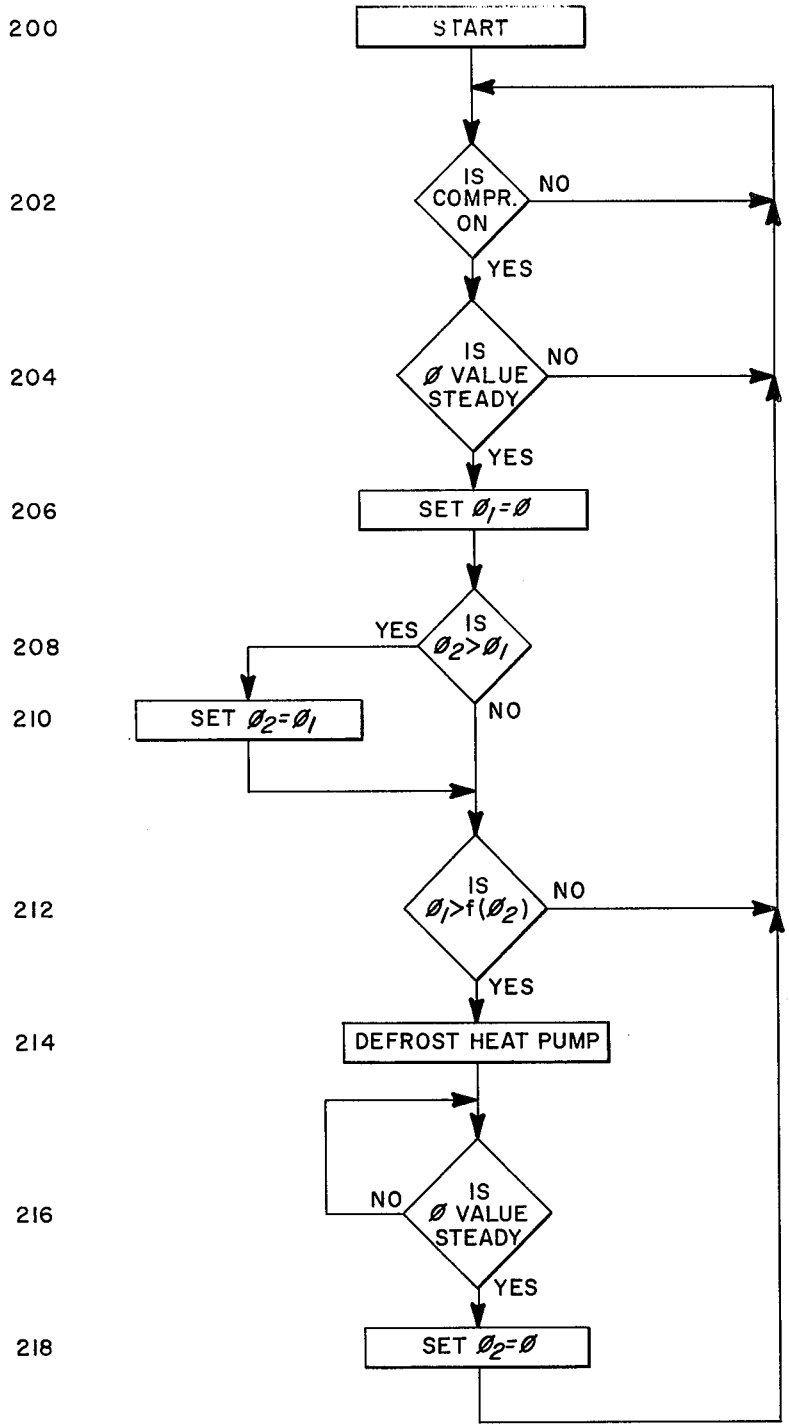
FIG. 4 is a flow chart detailing the method of initiating defrost based upon the phase angle detected.

Referring now to FIG. 4 there may be seen a flow chart of the logic used to regulate defrost. The flow chart includes start 200 from which the logic flows to step 202 to determine if the compressor is energized. If the answer is no the logic proceeds back to start. If the answer is yes the logic proceeds to step 204 to determine whether or not the phase angle is steady. This step is utilized to determine whether or not the refrigeration circuit has just been energized and has system transients or whether or not it is operating in steady state operation. If it is not in steady state operation the logic returns to start. If it is in steady state operation the logic then flows to step 206. At step 206 $phi_1$ is set equal to phi. Phi is the phase angle of the compressor motor detected at that point in time.

The logic then flows to step 208 wherein the question is $phi_2$ greater than $phi_1$ is asked. $Phi_2$ is the reference value of phi when the heat exchanger is in the frost free condition. Since $phi_2$ will be the lowest phase angle, if it is determined that the phase angle as detected is less than the reference phase angle then it would be known that the reference angle needs to be decreased. This might typically happen when the outdoor ambient temperature is rising and no defrost is necessary. If the answer at step 208 is yes the logic flows to step 210 and reference $phi_2$ is set equal to $phi_1$. If the answer is no at logic step 208 indicating that the reference value for the phase angle is smaller than the detected phase angle the logic then proceeds to step 212.

In step 212 the critical question is asked whether or not the phase angle detected as $phi_1$ is greater than a function of $phi_2$, the reference phase angle. By using this functional language it is indicated that a linear factor such as 1.1 or 1.2 might be utilized to indicate that if the phase angle is 10% or 20% greater than the reference angle it is time to initiate defrost. If the answer to the question at step 212 is yes the logic proceeds to step 214 to effect defrost of the heat pump in this case. If the answer in step 212 is no the logic proceeds back to start to begin the cycle again. The function of $phi_2$ language is also utilized to indicate that a non-linear relationship may be provided between the monitored phase angle and the level at which it is decided to initiate defrost. This might be particularly suitable for use with a microcomputer wherein a table of values may be provided such that this table will be utilized to look up the value of the function of a specific reference phase angle and it is to the table value the actual phase angle will be compared.

After logic has flowed to step 214 it then proceeds to step 216 to determine whether or not the phase angle is steady. If the answer is no the logic loops until the transients disappear. Once the phase angle is steady the logic flows to step 218 wherein $phi_2$ is set equal to phi or the reference value of the phase angle is set equal to the phase angle detected. This allows for the logic to be continually updated such that the reference value equals the value of the phase angle at the time defrost is completed. Hence, this new reference would then be utilized to determine whether or not the ongoing phase angle detected is sufficiently distinct from the function of the reference value to initiate another defrost.

The invention has been described in reference to a particular embodiment. It is to be understood by those skilled in the art that variations and modifications can be effected within the spirit and scope of the invention.

What is claimed is:

1. A method of determining when to initiate a defrost cycle to remove accumulated frost from a heat exchanger forming a portion of a refrigeration circuit including an electric motor driven compressor which comprises the steps of:

determining a reference phase angle equal to the phase angle of the electric motor driving the compressor when the heat exchanger is in a frost free condition;

monitoring the operating phase angle of the electric motor;

comparing the operating phase angle to the reference phase angle; and initiating a defrost cycle when the step of comparing determines the operating phase angle exceeds the reference phase angle by a predetermined value.

2. The method as set forth in claim 1 and further comprising the step of redetermining the reference phase angle of the electric motor indicative of the heat exchanger being in the frost free condition after the defrost cycle commenced by the step of initiating is complete.

3. The method as set forth in claim 2 and further comprising after the step of comparing the step of resetting the reference phase angle to equal the operating phase angle if the step of comparing determines the operating phase angle is less than the reference phase angle.

4. A defrost control for a heat exchange unit having a refrigeration circuit including a frost accumulating heat exchanger, an electric motor driven compressor and means for defrosting the heat exchanger which comprises:

means for continuously generating an output signal indicative of the phase angle of the motor;

storage means for storing the value of the output signal as a reference signal for when the heat exchanger is in the frost free condition;

comparator means for comparing the stored value of the reference signal with the output signal; and defrost initiation means for commencing operation of the means for defrosting the heat exchanger when the value of the output signal exceeds the value of the reference signal by a predetermined amount.

5. The apparatus as set forth in claim 4 and further comprising:

reset means for changing the value of the reference signal in the storage means to the value of the output signal upon operation of the means for defrosting the heat exchanger being discontinued.

6. The apparatus as set forth in claim 5 and further comprising:

update means for changing the value of the reference signal in the storage means to the value of the output signal should the value of the reference signal exceed the value of the output signal.

* * * * *